United States Patent [19]

Barisoni et al.

[11] 4,118,255

[45] Oct. 3, 1978

[54] PROCESS FOR THE PRODUCTION OF A SILICON STEEL STRIP WITH HIGH MAGNETIC CHARACTERISTICS

[75] Inventors: Mario Barisoni, Albano Laziale; Massimo Barteri, Rome; Roberto Ricci-Bitti, Lanuvio; Edmondo G. A. Marianeschi; Sandro C. Basevi, both of Terni; Carlo Borgianni; Carlo Santafe, both of Rome, all of Italy

[73] Assignees: Centro Sperimentale Metallurgico S.p.A; Terni Societa per l'Industria e'Elettricita S.p.A., both of Rome, Italy

[21] Appl. No.: 709,535

[22] Filed: Jul. 28, 1976

[30] Foreign Application Priority Data

Aug. 1, 1975 [IT] Italy ..... 50784/75

[51] Int. Cl.[2] ..... H01F 1/04

[52] U.S. Cl. ..... 148/111; 148/112

[58] Field of Search ..... 148/111, 112, 31.55; 75/123 L, 123 G

[56] References Cited

U.S. PATENT DOCUMENTS

| | | | |
|---|---|---|---|
| 3,671,337 | 6/1972 | Kumai et al. | 148/111 |
| 3,764,406 | 10/1973 | Littmann | 148/111 |
| 3,802,937 | 4/1974 | Kohler et al. | 148/111 |
| 3,855,020 | 12/1974 | Salseiver et al. | 148/112 |
| 3,872,704 | 3/1975 | Ohya et al. | 148/111 |
| 3,959,033 | 5/1976 | Barisoni et al. | 148/112 |

FOREIGN PATENT DOCUMENTS

| | | | |
|---|---|---|---|
| 2,262,869 | 7/1973 | Fed. Rep. of Germany | 148/111 |

OTHER PUBLICATIONS

Fiedler, H., *Solubility of Sulfur in Silicon-Iron,* Trans Aimme, 239, Feb, 1967, pp. 260-263.

Mehl, R., (Ed) *Metals Handbook,* vol. 7, Microstructures, Metals Park, Ohio (ASM) 1972, p. 16.

*Primary Examiner*—W. Stallard

*Attorney, Agent, or Firm*—Cushman, Darby & Cushman

[57] ABSTRACT

A process for inhibiting grain growth in the production of a single oriented continuously cast silicon steel strip with high magnetic characteristics, including the steps of continuously casting a silicon steel strip; solubilizing iron sulfide in the silicon steel strip by uniformly heating the strip to a temperature between 1050° and 1250° C; slowly cooling the silicon steel strip to a temperature below 500° C to precipitate dissolved sulfur as manganese sulfide; and hot-rolling the continuously cast silicon steel strip at a temperature over 1300° C.

8 Claims, 6 Drawing Figures

PROCESS FOR THE PRODUCTION OF A SILICON STEEL STRIP WITH HIGH MAGNETIC CHARACTERISTICS

The present invention refers to a procedure for the production of silicon steel strips for magnetic applications and in particular it concerns a procedure according to which it is possible to obtain, from continuously cast slab, silicon steel strips having a high magnetic permeability and low core losses.

Silicon steel with single oriented grains, reduced into thin sheets are primarily used as a magnetic core in transformers and other electric devices.

It is well known that applications in this field tend to demand higher and higher performances and smaller and smaller dimensions of the electric devices such as transformers and generators. For these reasons it is necessary that the silicon steel sheets used for the making of such electric devices possess higher and higher magnetic characteristics. In recent years there were described in the state of the art magnetic steels with magnetic permeability $B_{10}$ values higher than 1.9 Tesla, and with losses W 17/50 below 1.05 W/kg.

With the progress of the art, attempts were made to apply also to the field of silicon steels the continuous casting technique, which, as known, presents considerable advantages both from the economical and from the technical viewpoint, owing to the greater uniformity of the chemical composition attained in the steel and for the better surface appearance of the obtained slab.

Unfortunately, the normal processing procedure of other types of steel cannot be directly transferred to silicon steels for magnetic applications, inasmuch as for the latter, in order to obtain the desired final characteristics, it is necessary to first obtain the absence of defects and the great uniformity of composition and other satisfactory intermediate characteristics — such as given grain sizes or given sizes and distributions of impurities — which must be attained from the beginning in order to reach the desired quality of the final product.

Thus for instance, when compared with the normal annealing treatments, it is found that silicon steels for magnetic applications must be treated in a particular manner and with precautions which, as far as the annealing temperatures and duration is concerned, are very unusual for normal steels. This occurs because in silicon steels the grain sizes, which in any case grow during annealing, must be kept within accurate limits to avoid a considerable deterioration of the final magnetic characteristics.

This difficulty of transferring the normal techniques of treatment to silicon steels applies also to the technique continuous casting. In fact, the structure which is obtainable in continuously cast magnetic steels with conventional techniques is presently not satisfactory and results in products of inferior characteristics.

Many measures were suggested tending to permit the use of the continuous casting technique in the processing of steels for magnetic applications.

U.S. Pat. No. 3,727,669, granted to Centro Sperimentale Metallurgico S.p.A. and Terni Societa per l'Industria e l'Elettricita S.p.A. discloses a continuous casting procedure according to which it is possible to obtain products with good magnetic characteristics by limiting to a maximum the cooling of the slab both within the mold for continuous casting (primary cooling) as outside the mold (secondary cooling). In Japanese Pat.

74-24767 granted to Nippon Steel Co. an invention similar to that of the preceding patent is described.

The procedure according to the U.S. Pat. No. 3,727,669 has yielded excellent results, and is currently used in the processing of silicon steel for magnetic uses. However this procedure has the drawback of not completely utilizing the high hourly production capacity, which is an essential characteristic of the continuous casting procedure. In fact, in order to keep the cooling of the slab within the prescribed limits, it is necessary to cast slowly, to avoid the risk of breaking the skin of the slab at its issue from the mold.

The technological development in the art tends therefore to recover the full productivity of the continuous casting technique, while maintaining in the final product the required high magnetic characteristics. For this purpose other solutions have been proposed.

The published German application DT-OS No. 2,262,869, granted to Nippon Steel Co. teaches a procedure according to which a steel containing up to 4% Si is continuously cast in a conventional manner; the slab so obtained is heated to 1200°–1350° C. and kept in the temperature range between 1200° and 950 C for 30–200 seconds during hot rolling. According to this application, this treatment has the effect of redissolving the manganese sulfide which has already precipitated in a coarse and non uniform shape during the cooling of the slab while being continuously cast, and to cause it to reprecipitate during the stay of the slab between 1200° and 950° C.

However, according to our experience, this treatment must be carried out under extremely critical conditions. The treatment may easily lead to opposite results, because above 1200° C there exists the risk of an abnormal growth of the already rather large columnar grain formed during the continuous casting procedure. Actually, the quality of the sheet so obtained is not very high: in fact, the values quoted in this specification are magnetic induction B 8 = 1.74 – 1.87 Wb/m$^2$ and for the losses W 17/50 = 1.17 – 1.58 W/kg.

U.S. Pat. No. 3,764,407 granted to ARMCO Steel Co. discloses a procedure wherein the continuously cast slabs are heated to 750°–1250°C, hot rolled at this temperature with a reduction ratio of at least 5%, thereafter heated again to over 1350° and again hot rolled to a thicknesss of 2.5 mm or less.

In the Nippon Steel Co. Belgian Pat. No. 797,781 there is described a procedure according to which a slab is heated to a temperature below 1300° C, is subjected to a first hot rolling step with a reduction ratio between 30 and 70%, and is successively annealed at a temperature of over 1350° C and again hot rolled to a final thickness of 2–3 mm. The strip so obtained is thereafter annealed to 1050° C, quenched and cold rolled in a single stage.

In both instances, the first rolling step with a low reduction ratio supposedly served to produce a structure, which prevents abnormal grain growth during heating to a temperature above 1350° C, which precedes the final hot rolling.

As far as we know, among all the procedures which tend to use the conventional continuous casting technique with high casting and cooling rates, this procedure is the only one which has had some industrial application. However, it is very costly owning to the fact that it requires two hot rolling steps with different reduction ratios.

In summary, according to the known state of the art, the difficulties inherent in the use of a conventional continuous casting in a cycle for the production of silicon steel for magnetic sheet material are:

— formation of large columnar grains during the cooling of the continuously cast slab;

— abnormal grain growth—known as grain explosion—during the annealing step at a temperature over 1300° C prior to hot rolling.

This grain explosion is attributed to a non-uniform precipitation of the manganese sulfide and theoretically it should be avoided by critical heat treatments in order to more uniformly redistribute the manganese sulfide, or by using expensive pre-rolling treatments.

The sulfide problem makes itself very much felt, so much so that even using ingot casting, the Russian Pat. No. 430 953, suggests adding sulfur into the ingot after the solidification of an external layer of 50–70 mm, in order to improve the magnetic properties of the steel.

It is the object of the present invention to provide a procedure which permits, with the casting and cooling rates normally used in the continuous casting of silicon steels, to continuously cast a silicon steel for magnetic applications and which, at the same time, makes it possible to avoid heat treatments which are critical, whose efficiency is questionable or expensive hot-prerolling operations, although permitting to reach high magnetic characteristics in the final product.

As already mentioned, during the heating to 1400° C prior to the hot rolling of slabs, which have been continuously cast with traditional techniques, that is to say with high cooling rates, there occurs an abnormal grain growth, called grain explosion, which causes a considerable deterioration of the magnetic characteristics of the final sheet.

As already mentioned, this grain growth has hitherto been ascribed to the fact that manganese sulfide was supposed to precipitate in these slabs in a non-uniform distribution and sizes, for which reason it could not carry out its well known function of grain growth inhibitor. In this manner the large columnar grains formed during the coolng of the continuously cast slab would grow further in the manganese sulfide deficient region. This occasioned the above mentioned solutions to dissolve and reprecipitate in a more suitable form the manganese sulfide, or to destroy by means of a hot rolling procedure with a small rate of reduction, the columnar solidification structure.

During the study of the grain explosion problem, which has led to the present invention, it has been ascertained that said explosion does not begin from the internal layer with its large columnar crystals but from the thin external skin layer where the grains are very small.

The examination of some samples obtained from the skin and from the center, both of ingots and of continuously cast slabs, has sown that while in the ingots the sulphur is always and prevalently present as manganese sulfide, in the continuously cast slabs the sulfur, as a function of the cooling conditions, is present either in solution or in the form of iron sulfide, and in some cases is also associated, in the center of the slab, with limited amounts of manganese sulfide. In any case, the skin of the slab almost never contains sulfide precipitates, the sulphur always being in solution in the iron.

This clearly explains the phenomenon we observed that the grain explodes starting from the skin. In fact, in the skin the grain is free to grow starting from relatively low temperatures since no inhibitors of any kind are present; the explosion spreads towards the center of the slab since with the increase of the annealing temperature the iron sulfide dissolves and therefore cannot act as a grain growth inhibitor. This pathway of action is confirmed by the observation, already known to those in the art, that by eliminating the superficial skin layers the grain explosion is retarded or even in great part eliminated.

According to the present invention it is therefore necessary to eliminate these unfavorable conditions, by causing the formation of manganese sulfide precipitates throughout the whole section of the slab, however without reaching during the heat treatment, temperatures such as to cause the explosion of the grains present in the skin of the slab.

The present invention will now be described in detail and with reference to the attached drawings, wherein.

Figure 1:
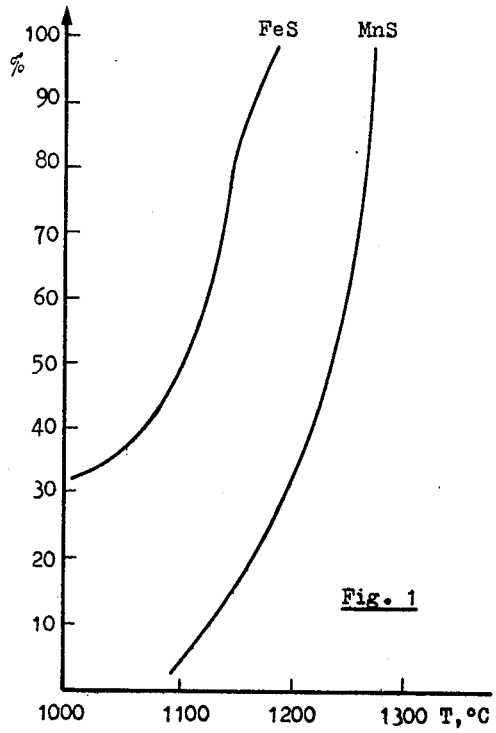
FIG. 1 is a diagram showing the solubilization curve of iron sulfide and manganese sulfide in a steel matrix, obtained by means of the differential thermal analysis.

According to the present invention a steel having the following weight composition: C less than 0.05%, Si from 2.5 to 3.5%, Mn from 0.05 to 0.15%, S from 0.020 to 0.035%, the balance being iron and minor impurities, with the possible addition of aluminum, is continuously cast at the traditional cooling rate. The so obtained slabs are heated in the temperature range between 1050° and 1250° C, preferably between 1100 and 1200° C, soaked at this temperature for a time comprised between 10 and 200 minutes, in order to render the temperature uniform throughout the whole slab section, thereafter withdrawn from the furnace and slowly cooled in the pit at a temperature below 500° C, that is to say at a cooling rate comparable to that of an ingot of the same weight. In such a manner it is possible to carry into solution at least 80% of the precipitated iron sulfide during the cooling of the continuously cast slabs. The reheating temperature is however not such as to cause grain explosion in the slab skin, which grow only in a limited manner. During the slow cooling in the pit the sulphur passed into solution will reprecipitate as manganese sulfide owing to the suitable cooling speed.

After this treatment the slabs are again heated, this time to a temperature over 1350° C, and thereafter hot rolled in a conventional manner to a thickness between 2 and 3 mm. The strip so obtained is further processed according to any of the procedures known in the state of the art for the production of magnetic sheet with high permeability characteristics, such as for instance those described in the Belgian patent 817 962 or in the Italian application 53 432 A 74, both filed in the name of the same applicants as that of the present patent.

In the drawings, FIG. 1 shows a solubility diagram of Iron sulfide in an alloy Fe — 3% Si (curve marked FeS) and of manganese sulfide (curve marked MnS). These curves, obtained by a differential thermal analysis, show that at 1000° C more than 30% of the iron sulfide is already dissolved, and practically it is completely dissolved at 1200° C. Manganese sulfide instead dissolves at a higher temperature and at 1200° C less than 30% of it is dissolved. Furthermore it must be noted that the curves of differential thermal analysis are obtained in conditions very near to equilibrium, while in practice, at the industrially used heating rate, the kinetics of the dissolution of manganese sulfide are less than that of iron sulfide.

Figure 2:
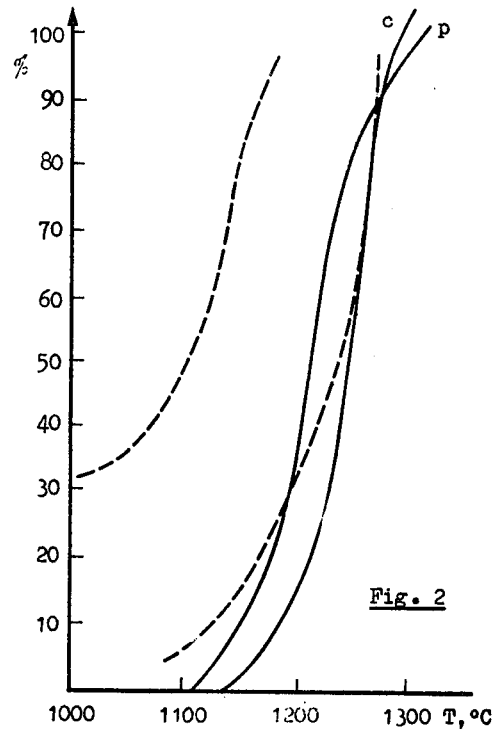
FIG. 2 is a diagram similar to that of FIG. 1, showing the solubilization curves of the sulfide in the skin and in the center of an ingot, with the curves of diagram 1 shown in dotted lines as a reference.
Figure 3:
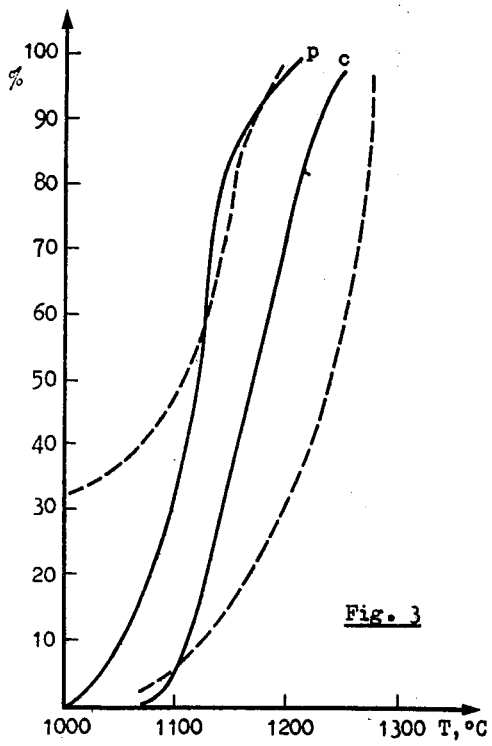
FIG. 3 is a diagram similar to that of FIG. 1, showing the solubilization curves of the sulfides in the skin and in the center of a slab which has been continuously cast at a considerable cooling rate, with the curves of FIG. 1 shown in dotted lines as a reference.
Figure 4:
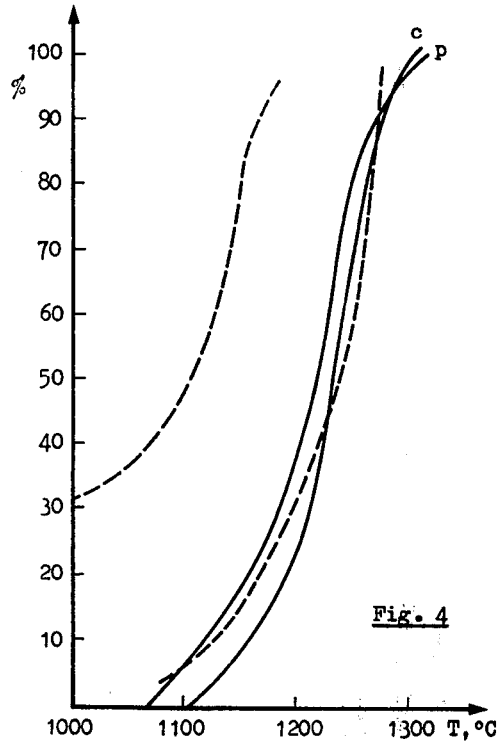
FIG. 4 is a diagram similar to that of FIG. 1, showing the solubilization curves of the sulfides in the skin and in the center of a slab which is has been continuously cast at a considerable cooling rate and treated according to the present invention, with the curves of FIG. 1 shown in dotted lines as a reference.

For the sake of comparison diagram 1 is shown in dotted lines also in FIGS. 2, 3 and 4, wherein there are respectively shown the dissolution curves of the sulfide which are respectively present in an ingot, in a slab continuously cast in a traditional manner and in a slab continuously cast in a traditional manner and subjected to a procedure according to the present invention. In all three cases the steel had the above stated composition. FIG. 2 shows that both in the skin (curve marked p) and in the center (curve marked c), in the ingots the composition of the sulfide corresponds in a practically exact manner to manganese sulfide. In the slabs continuously cast in a traditional manner (FIG. 3) we see instead that both in the skin and in the center the sulfides mainly consist of iron sulfide.

When treating the continuously cast slabs with the procedure according to the present invention, the sulfur present in solution or as iron sulfide is reprecipitated essentially as manganese sulfide, as clearly shown in FIG. 4. According to the present invention it is therefore possible to lead the sulfides present in a continuously cast slab into a composition similar to that of the sulfides present in an ingot.

Thus the object of the present invention is attained to permit, without excessively expensive operations, the use of conventional type continuous casting, with its typical cooling rates, for the production of a steel for magnetic applications having the same characteristics of an ingot cast steel.

Figure 5:
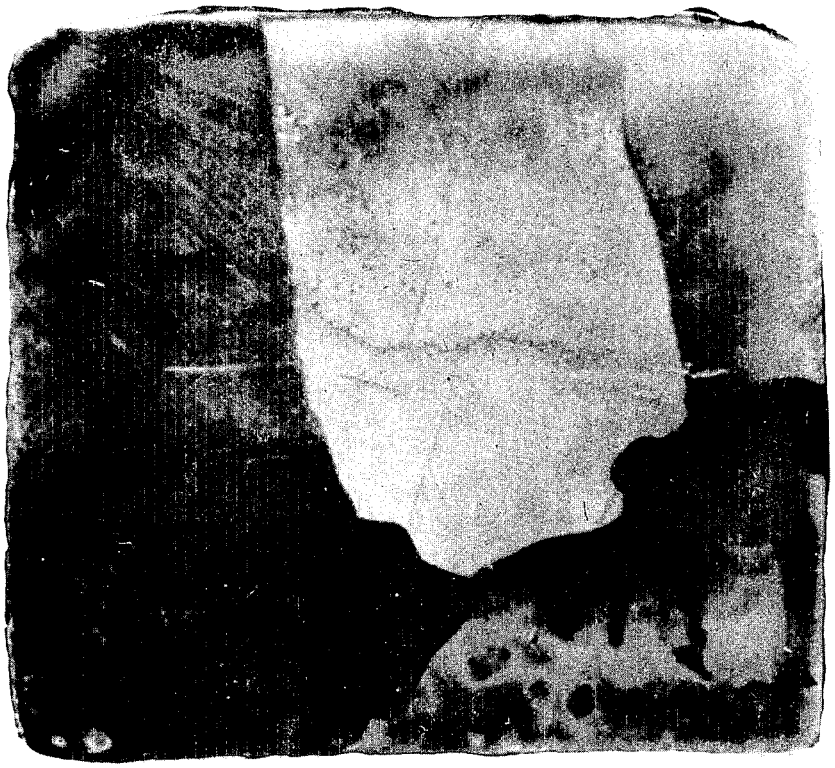
FIG. 5 is a macrography of a cross-section of the slab of FIG. 3.
Figure 6:
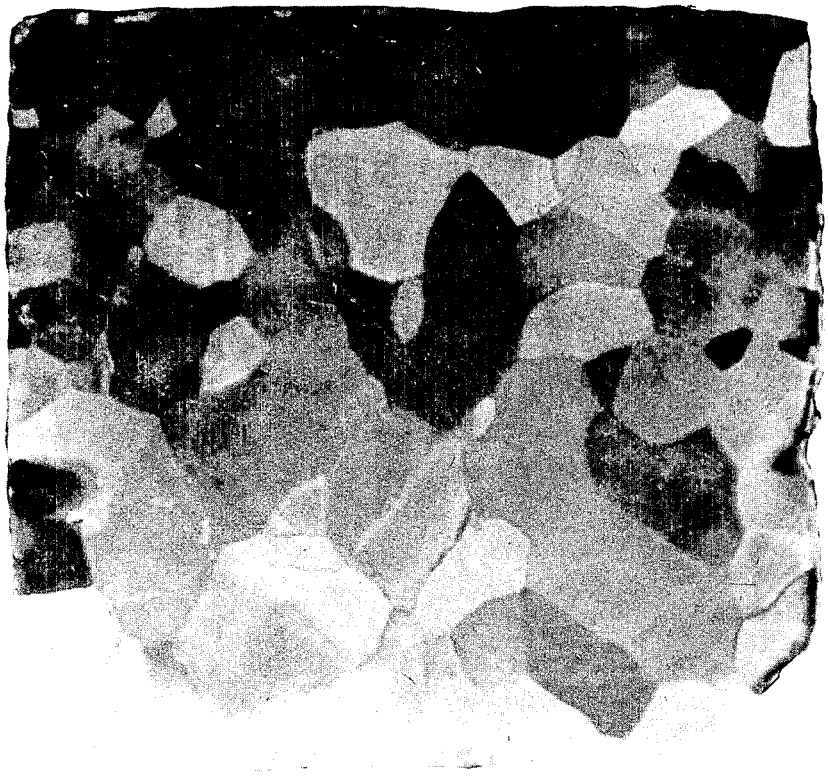
FIG. 6 is a macrography of a cross-section of the slab of FIG. 4.

FIGS. 5 and 6 show a comparison between a structure obtained when processing according to known techniques a continuously cast steel (FIG. 5) and a structure obtained when processing with the same techniques a steel which has been continuously cast and subjected to the treatment according to the present invention.

EXAMPLE

A steel having the following weight composition: C = 0.04%; Si = 2.9%; Mn = 0.08%; S = 0.03%; Al = 0.04%; N = 0.0075%, the balance being minor impurities, is ingot cast and continuously cast, with the normal amount of cooling water. The continuously cast slabs measure 140 × 990 mm.

The slabs obtained by continuous casting are divided into two groups, one of which is treated, according to the present invention, by heating it to 1180° C, keeping the slab at this temperature for 80 minutes and thereafter withdrawing the slabs from the furnace and cooling them slowly in pit to a temperature of 400° C.

Both the ingots and the two groups of slabs are thereafter heated to 1380° C and hot rolled to a thickness of 2.1 mm.

The hot rolled strips are thereafter annealed, slowly cooled to 850° C, water quenched from 850° C, cold rolled with a reduction ratio of 87% and finally subjected to annealing in wet $H_2$ for 2 minutes and to final annealing in $H_2$ and $N_2$. The strips so obtained present the following mean magnetic characteristics:

| | Permeability B 10 | Losses 17/50 W/kg |
|---|---|---|
| Strips obtained from ingots | 19200 ± 150 | <1.05 |
| Strips obtained from c. c. slabs | 18100 ± 700 | 1.10 ÷ 1.50 |
| Strips from c. c. slabs treated according to invention | 19210 ± 100 | <1.05 |

We claim:

1. A process for inhibiting grain growth in the production of a single oriented continuously cast silicon steel strip with high magnetic characteristics, comprising in sequence:

continuously casting a silicon steel strip;

solubilizing iron sulfide in said silicon steel strip by uniformly heating said silicon steel strip to a temperature between 1050° and 1250° C;

slowly cooling said silicon steel strip to a temperature below 500° C to precipitate dissolved sulphur as manganese sulfide; and hot-rolling said continuously cast silicon steel strip at a temperature over 1300° C to a thickness of 2 to 3 mm.

2. A process according to claim 1, including a silicon steel strip having the following weight percent composition:

C — less than .05%,
Si — from 2.5 to 3.5%,
Mn — from 0.05 to 0.15%,
S — from 0.020 to 0.035%,
Al — from 0 to 0.01%, and the balance being iron and minor impurities.

3. A process according to claim 1, wherein at least 80% of the iron sulfide is solubilized by uniformly heating the strip to a temperature between 1100° and 1200° C and the precipitation of manganese sulfide is obtained by cooling the strip at a cooling rate selected to precipitate dissolved sulfur as manganese sulfide and yield a product exhibiting a magnetic permeability $B_{10}$ of 19,210 ± 100.

4. Single oriented continuously cast silicon steel strips, as obtained by the procedure claimed in claim 1.

5. A process according to claim 1, including after hot rolling;

annealing the continuously cast silicon steel strip at a temperature ranging from 1050° to 1250° C for a soaking time between 2 and 200 seconds;

slowly cooling and quenching at a temperature ranging from 700° to 900° C.;

cold rolling with a reduction ratio between 80 and 90% and annealing in wet hydrogen and finally annealing in a mixture of hydrogen and nitrogen.

6. A process according to claim 1, wherein prior to hot rolling continuously cast silicon steel strips are heated to a temperature ranging from 1050° to 1250° C for a time between 10 and 200 minutes, slowly cooled to a temperature below 500°, and again heated to a temperature over 1350° C.

7. A process according to claim 6 including heating continuously cast silicon steel strips to a temperature from 1100° to 1200° C for a time between 10 and 200 minutes, slowly cooling said steel strips to a temperature below 500° C, and again heating said steel strips to a temperature over 1350° C.

8. A process for inhibiting grain growth in the production of a single oriented continuously cast silicon steel strip having the following weight percent composition:

| | |
|---|---|
| Carbon | less than 0.05% |
| Silicon | from 2.5 to 3.5% |
| Manganese | from 0.05 to 0.15% |
| Sulfur | from 0.020 to 0.035% |
| Aluminum | from 0 to 0.01% and |

the balance being iron and minor impurities, comprising in sequence:

continuously casting a silicon steel strip;

solubilizing at least 80% of the precipitated iron sulfide in said silicon steel strip by uniformly heating said silicon steel strip to a temperature between 1050° and 1250° C;

slowly cooling said silicon steel strip to a temperature below 500° C at a cooling rate selected to precipitate dissolved sulfur as manganese sulfide; and hot-rolling said continuously cast silicon steel strip at a temperature over 1300° C.

* * * * *